US012529382B2

(12) United States Patent
Cheah et al.

(10) Patent No.: US 12,529,382 B2
(45) Date of Patent: Jan. 20, 2026

(54) HIGH VISCOSITY STAGE

(71) Applicant: Schlumberger Technology Corporation, Sugar Land, TX (US)

(72) Inventors: Kean Wee Cheah, Singapore (SG); David Milton Eslinger, Bartlesville, OK (US)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 18/689,754

(22) PCT Filed: Sep. 23, 2022

(86) PCT No.: PCT/US2022/044518
§ 371 (c)(1),
(2) Date: Mar. 6, 2024

(87) PCT Pub. No.: WO2023/049333
PCT Pub. Date: Mar. 30, 2023

(65) Prior Publication Data

US 2024/0384722 A1 Nov. 21, 2024

Related U.S. Application Data

(60) Provisional application No. 63/261,621, filed on Sep. 24, 2021.

(51) Int. Cl.

| | |
|---|---|
| ***F04D 13/08*** | (2006.01) |
| ***F04D 29/30*** | (2006.01) |
| ***F04D 29/44*** | (2006.01) |

(52) U.S. Cl.
CPC ..... *F04D 13/08* (2013.01); *F04D 29/30* (2013.01); *F04D 29/444* (2013.01)

(58) Field of Classification Search
CPC ..... F04D 13/08; F04D 29/30; F04D 29/444
See application file for complete search history.

(56) References Cited

U.S. PATENT DOCUMENTS

| | | | | |
|---|---|---|---|---|
| 5,159,977 | A | 11/1992 | Zabaras | |
| 5,845,709 | A * | 12/1998 | Mack | F04B 47/06 166/57 |
| 6,854,517 | B2 | 2/2005 | Gay | |
| 7,409,997 | B2 | 8/2008 | Gay | |

(Continued)

FOREIGN PATENT DOCUMENTS

| | | |
|---|---|---|
| CA | 2419458 C | 8/2009 |
| CA | 2659492 C | 4/2013 |

(Continued)

OTHER PUBLICATIONS

Kurokawa, et al. in "Performance Improvement and Peculiar Behavior of Disk Friction and Leakage in Very Low Specific Speed Pumps", Proc of 1st International Symposium of Fluid Engineering (Beijing, Chine) vol. 1 pp. 176-182.

(Continued)

*Primary Examiner* — Connor J Tremarche
(74) *Attorney, Agent, or Firm* — Jeffrey D. Frantz

(57) ABSTRACT

An electric submersible pump stage optimized for viscous fluid is provided. The stage can include a diffuser having a curved break water area. The stage can include an impeller having a cut back shroud and/or hub.

16 Claims, 11 Drawing Sheets

(56) References Cited

U.S. PATENT DOCUMENTS

| | | | | |
|---|---|---|---|---|
| 8,066,476 | B2 | 11/2011 | Orban | |
| 9,506,471 | B2 | 11/2016 | Eslinger | |
| 10,451,079 | B2 | 10/2019 | Chang | |
| 10,738,794 | B2 | 8/2020 | Rao | |
| 11,041,496 | B2 | 6/2021 | Cheah | |
| 11,085,451 | B2 | 8/2021 | Lee | |
| 2005/0034872 | A1* | 2/2005 | Gay | E21B 43/128 166/369 |
| 2012/0020777 | A1 | 1/2012 | Eslinger | |
| 2017/0167498 | A1* | 6/2017 | Chang | F04D 13/10 |
| 2017/0241424 | A1* | 8/2017 | Patil | F04D 29/2266 |
| 2018/0195514 | A1* | 7/2018 | Cheah | F04D 29/0413 |
| 2018/0291917 | A1* | 10/2018 | Webster | F04D 13/10 |
| 2020/0263703 | A1 | 8/2020 | Hill | |
| 2020/0325901 | A1* | 10/2020 | Lee | F04D 29/2233 |
| 2021/0190075 | A1 | 6/2021 | Sheth | |
| 2022/0341435 | A1 | 10/2022 | Cheah | |
| 2023/0108948 | A1 | 4/2023 | Brown | |

FOREIGN PATENT DOCUMENTS

| | | | | |
|---|---|---|---|---|
| JP | S5879698 | A | 5/1983 | |
| WO | 2015023636 | A1 | 2/2015 | |
| WO | 2015049647 | A1 | 4/2015 | |
| WO | WO-2017066206 | A1 * | 4/2017 | F04D 29/086 |
| WO | 2019079070 | A1 | 4/2019 | |

OTHER PUBLICATIONS

Search Report and Written Opinion of International Patent Application No. PCT/US2022/044518 dated Jan. 13, 2023; 12 pages.

* cited by examiner

Stage Performance at 555-cP & 3600-rpm

HIGH VISCOSITY STAGE

CROSS-REFERENCE TO RELATED APPLICATIONS

The present application is a National Stage Entry of International Application No. PCT/US2022/044518, filed Sep. 23, 2022, which claims priority benefit of U.S. Provisional Application No. 63/261,621, filed Sep. 24, 2021, the entirety of which is incorporated by reference herein and should be considered part of this specification.

BACKGROUND

Field

The present disclosure generally relates to electric submersible pumps, and more particularly to a stage design for highly viscous applications.

Description of the Related Art

Various types of artificial lift equipment and methods are available, for example, electric submersible pumps (ESPs). An ESP includes multiple centrifugal pump stages mounted in series, each stage including a rotating impeller and a stationary diffuser mounted on a shaft, which is coupled to a motor. In use, the motor rotates the shaft, which in turn rotates the impellers within the diffusers. Well fluid flows into the lowest stage and passes through the first impeller, which centrifuges the fluid radially outward such that the fluid gains energy in the form of velocity. Upon exiting the impeller, the fluid flows into the associated diffuser, where fluid velocity is converted to pressure. As the fluid moves through the pump stages, the fluid incrementally gains pressure until the fluid has sufficient energy to travel to the well surface.

SUMMARY

In some configurations, an electric submersible pump stage includes a rotating impeller and a stationary diffuser. The diffuser can include a curved break water area.

The impeller can include a hub, an upper shroud extending from the hub, a lower shroud generally circumferentially surrounding the upper shroud, a plurality of vanes extending between the lower shroud and the hub and/or upper shroud, and a fluid exit defined between downstream ends of the upper shroud and the lower shroud. The curved break water area can be located proximate the fluid exit of the impeller. The diffuser can include a central hub, a balance ring step radially spaced from and radially or circumferentially surrounding the central hub, a lower plate extending between and connecting the balance ring step and the central hub, an outer housing radially spaced from and radially or circumferentially surrounding the balance ring step, and a plurality of blades extending between the outer housing and the balance ring step and/or lower plate. A radially inner surface of the outer housing can include the curved break water area.

The impeller can include a cutback upper shroud and/or cutback lower shroud. A diameter of the upper shroud can be less than an outer diameter of the vanes of the impeller. A diameter of the lower shroud can be less than an outer diameter of the vanes of the impeller.

In some configurations, an electric submersible pump stage includes a stationary diffuser and a rotating impeller. The impeller includes a hub, an upper shroud extending from the hub, a lower shroud generally circumferentially surrounding the upper shroud, a plurality of vanes extending between the lower shroud and the hub and/or upper shroud, and a fluid exit defined between downstream ends of the upper shroud and the lower shroud. The upper shroud and/or lower shroud is reduced or cut back.

A diameter of the upper shroud can be less than an outer diameter of the vanes of the impeller. A diameter of the lower shroud can be less than an outer diameter of the vanes of the impeller.

The diffuser can include a break water area. The diffuser can include a central hub, a balance ring step radially spaced from and radially or circumferentially surrounding the central hub, a lower plate extending between and connecting the balance ring step and the central hub, an outer housing radially spaced from and radially or circumferentially surrounding the balance ring step, and a plurality of blades extending between the outer housing and the balance ring step and/or lower plate. A radially inner surface of the outer housing can include the curved break water area.

In some configurations, an electric submersible pump stage includes a rotating impeller including an inlet and an outlet, and an associated stationary diffuser configured to receive fluid exiting the outlet of the impeller.

The diffuser can include a central hub configured to surround a shaft; a balance ring step radially spaced from and circumferentially surrounding the central hub; a lower plate extending between and connecting the balance ring step and the central hub; an outer housing radially spaced from and circumferentially surrounding the balance ring step; and a plurality of blades extending between the outer housing and the balance ring step and/or lower plate. At least portions of the outer housing, balance ring step, blades, and/or lower plate define a fluid flow path through the diffuser. A radially inner surface of the outer housing includes a region configured to be contacted by the fluid exiting the outlet of the impeller. The region has a curved profile.

The region can be concave from a perspective inside the fluid flow path through the diffuser. The region can curve or bulge radially outward. The region can be located adjacent or proximate the outlet of the impeller.

The impeller can include a hub, an upper shroud extending from the hub, a lower shroud generally circumferentially surrounding the upper shroud, and a plurality of vanes extending between the lower shroud and the hub and/or upper shroud, the outlet defined between downstream ends of the upper shroud and the lower shroud. The upper shroud and/or lower shroud can be reduced or cut back. A diameter of the upper shroud and/or lower shroud can be less than an outer diameter of the vanes of the impeller.

BRIEF DESCRIPTION OF THE FIGURES

Certain embodiments, features, aspects, and advantages of the disclosure will hereafter be described with reference to the accompanying drawings, wherein like reference numerals denote like elements. It should be understood that the accompanying figures illustrate the various implementations described herein and are not meant to limit the scope of various technologies described herein.

DETAILED DESCRIPTION

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Figure 1:
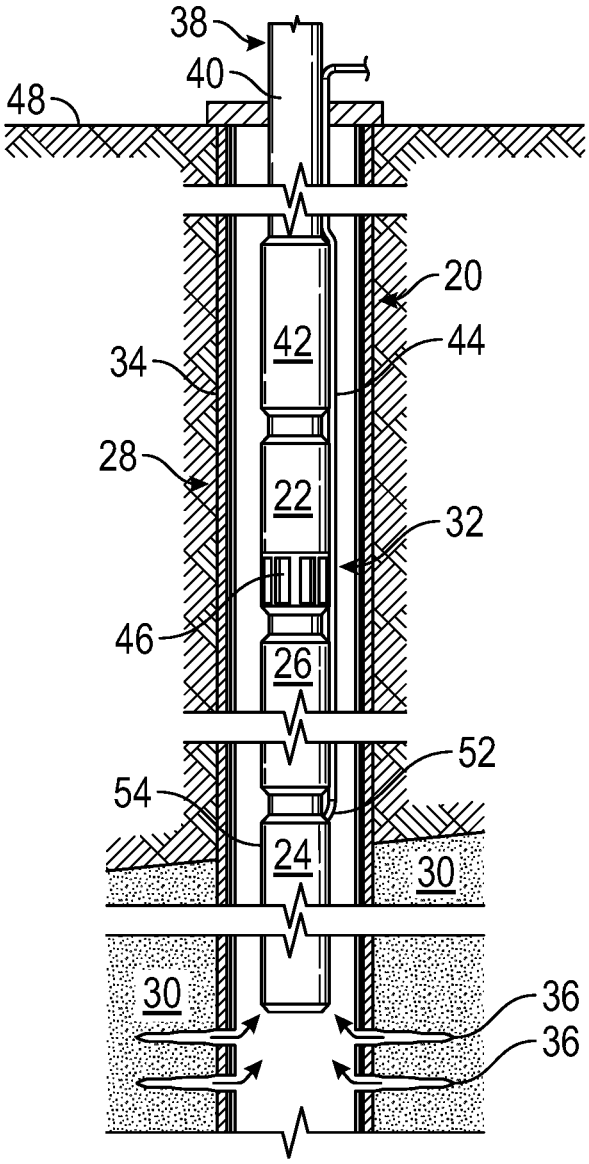
FIG. 1 shows a schematic of an electric submersible pump (ESP) system.

Various types of artificial lift equipment and methods are available, for example, electric submersible pumps (ESP). Electric Submersible Pump (ESP) systems are used in a variety of well applications. ESP systems may comprise centrifugal pumps having a plurality of stages with each stage employing a diffuser and an impeller. Referring generally to FIG. 1, an embodiment of a submersible pumping system 20, such as an electric submersible pumping system, is illustrated. Submersible pumping system 20 may comprise a variety of components depending on the particular application or environment in which it is used. Examples of components utilized in pumping system 20 comprise at least one submersible pump 22, at least one submersible motor 24, and at least one protector 26 coupled together to form the submersible pumping system 20.

In the example illustrated, submersible pumping system 20 is designed for deployment in a well 28 within a geological formation 30 containing desirable production fluids, such as petroleum. A wellbore 32 is drilled into formation 30, and, in at least some applications, is lined with a wellbore casing 34. Perforations 36 are formed through wellbore casing 34 to enable flow of fluids between the surrounding formation 30 and the wellbore 32.

Submersible pumping system 20 is deployed in wellbore 32 by a conveyance system 38 that may have a variety of configurations. For example, conveyance system 38 may comprise tubing 40, such as coiled tubing or production tubing, connected to submersible pump 22 by a connector 42. Power is provided to the at least one submersible motor 24 via a power cable 44. The submersible motor 24, in turn, powers submersible pump 22 which can be used to draw in production fluid through a pump intake 46. In a variety of applications, the submersible pump 22 may comprise a centrifugal pump. Within the submersible centrifugal pump 22, a plurality of impellers is rotated between diffusers to pump or produce the production fluid through, for example, tubing 40 to a desired collection location which may be at a surface 48 of the Earth.

Many types of electric submersible pumping systems and other types of submersible pumping systems can benefit from the features described herein. Additionally, other components may be added to the pumping system 20, and other deployment systems may be used. Depending on the application, the production fluids may be pumped to the collection location through tubing 40 or through the annulus around deployment system 38. The submersible pump or pumps 22 also may utilize different types of stages, such as mixed flow stages or radial flow stages, having various styles of impellers and diffusers.

Figure 2:
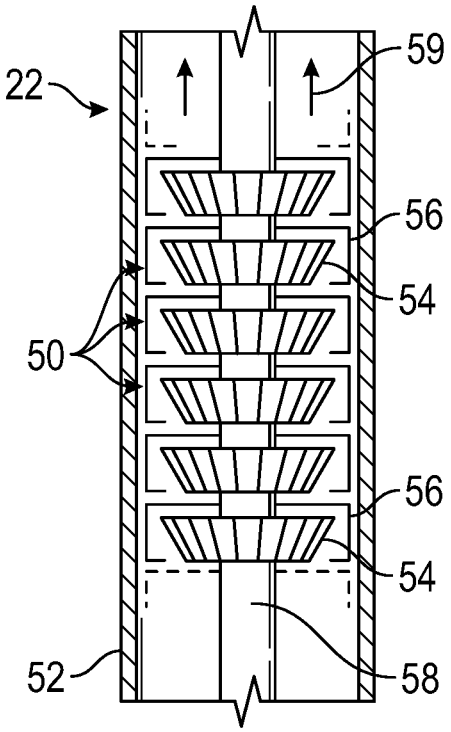
FIG. 2 shows a schematic of a plurality of ESP stages.
Figure 3:
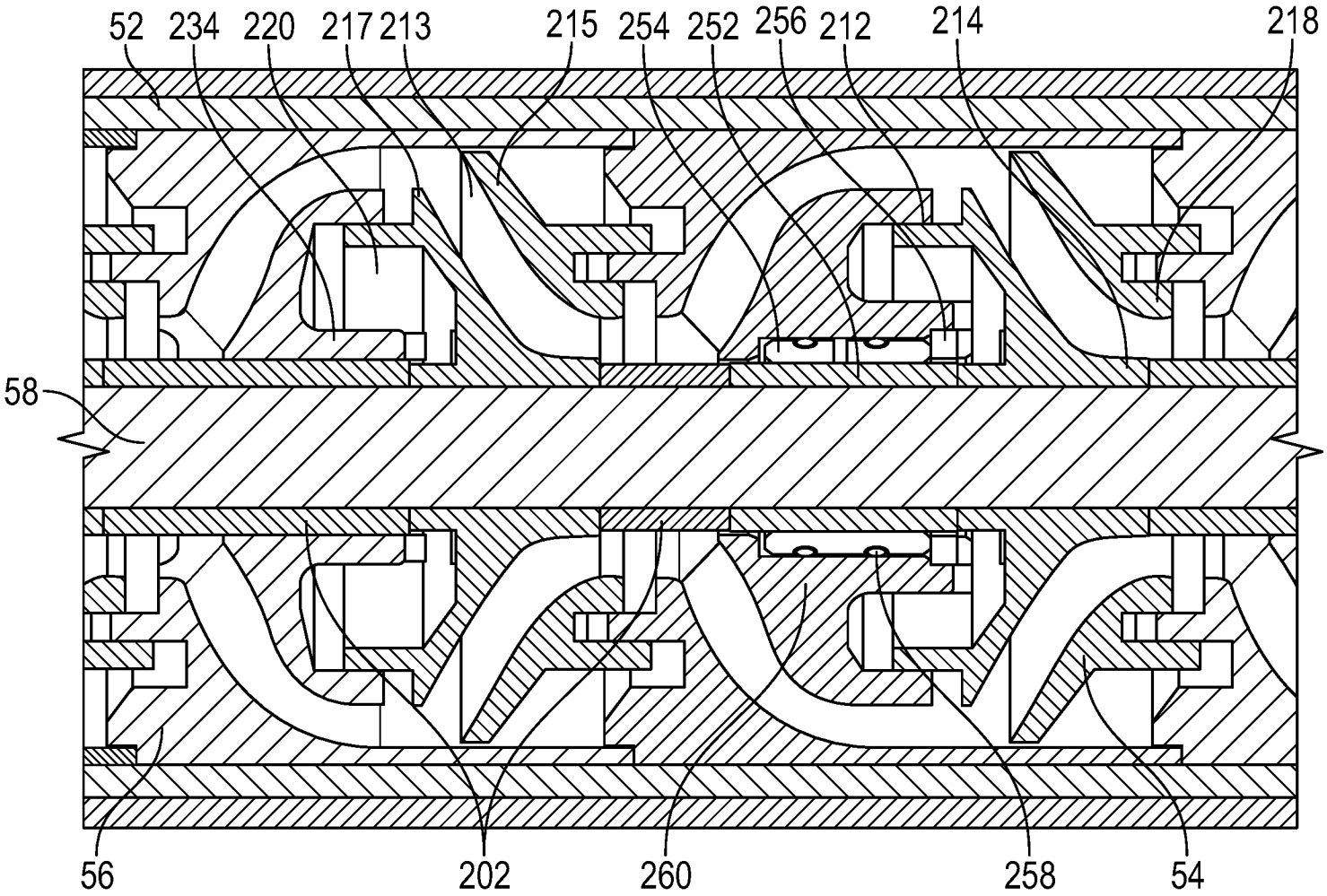
FIG. 3 shows a longitudinal cross-section of a portion of an ESP.

Referring generally to FIG. 2, a portion of an embodiment of submersible pump 22 is illustrated. In this embodiment, the submersible pump 22 is a centrifugal pump comprising at least one stage and often a plurality of stages 50 disposed within an outer pump housing 52. Each stage 50 comprises pump components for inducing and directing fluid flow. As illustrated, the pump components in each stage comprise an impeller 54 and a diffuser 56. Impellers 54 are rotated by a shaft 58 coupled with an appropriate power source, such as submersible motor 24, to pump fluid through centrifugal pump 22 in the direction of arrow 59. As shown in FIG. 3, one or more spacers 202 can be disposed axially between sequential impellers 54.

Each rotating impeller 54 moves fluid from the upstream diffuser 56 into and through the downstream diffuser 56 and into the next sequential impeller 54 until the fluid is expelled from centrifugal pump 22. By way of example, each rotating impeller 54 may discharge fluid to the adjacent downstream diffuser 56 which routes the fluid into a diffuser bowl for receipt by the next sequential impeller 54. The fluid flow is routed through the sequential stages 50 of the submersible centrifugal pump 22 until the fluid is expelled from the submersible pump 22.

Figure 4:
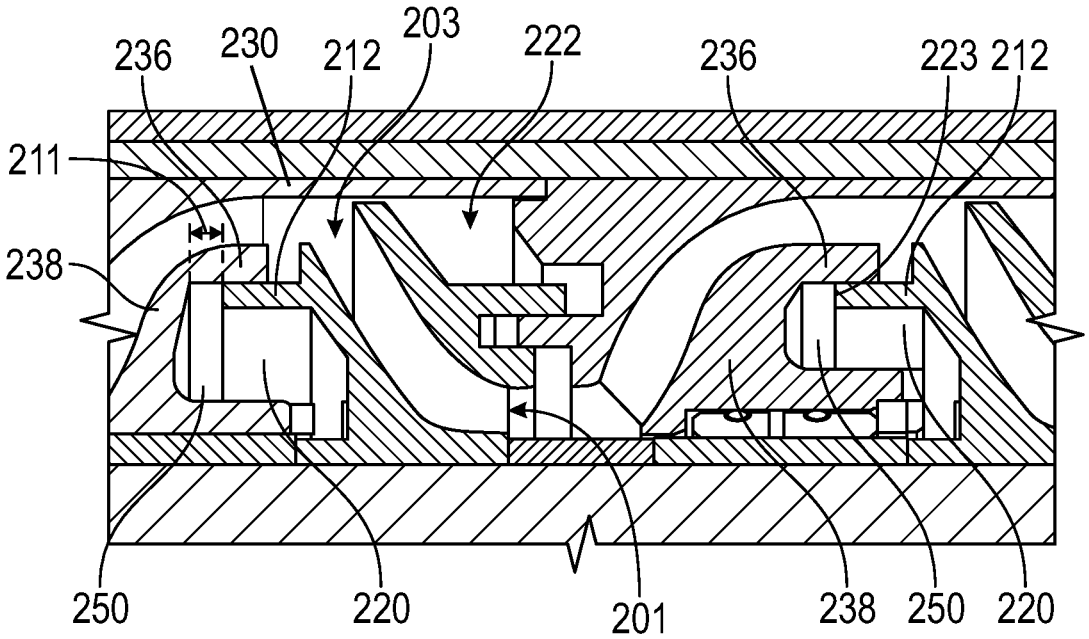
FIG. 4 shows an enlarged portion of FIG. 3.

FIG. 3 shows a partial longitudinal cross-section of an ESP layout, and FIG. 4 shows an enlarged portion of FIG. 3. As shown, a bearing assembly can be disposed between, e.g., at least partially radially between, the shaft 58 and a diffuser 56 and/or between, e.g., at least partially axially between, an impeller 54 and its associated diffuser 56. A portion of the diffuser 56 can act as a bearing housing 260. In the illustrated embodiment, the bearing assembly includes a bearing sleeve 252 disposed about the shaft 58 and a bushing 254 disposed about the bearing sleeve 252 and radially between the bearing sleeve 252 and a portion of the diffuser 56 (e.g., the bearing housing 260). One or more o-rings 258 can be disposed about the bushing 254, for example, radially between the bushing 254 and the diffuser 56 or bearing housing 260.

The illustrated bearing assembly also includes an anti-rotation upthrust ring 256 disposed about the bearing sleeve 252. As shown, the anti-rotation upthrust ring 256 can be disposed adjacent an upstream end of the bushing 254. The bearing sleeve 252 is keyed or rotationally coupled to the shaft 58 such that the bearing sleeve 252 rotates with the shaft 58 in use. The anti-rotation upthrust ring 256 prevents or inhibits the bushing 254 from rotating such that the bushing 254 is stationary or rotationally fixed relative to the diffuser 56. The anti-rotation upthrust ring 256 can also help prevent or inhibit axial movement of the bushing 254 and/or the bushing 254 from dropping out of place from the bearing housing 260. In use, the bearing assembly can help absorb thrust and/or accommodate the rotation of the shaft relative to the diffuser.

The impeller 54 includes a central hub 214, surrounding a bore through which the shaft 58 extends, and a skirt 218 radially or circumferentially surrounding a portion of the hub 214. A space between (e.g., radially between) the skirt 218 and hub 214 defines an intake or inlet 201 of the impeller 54 and a portion of a flow path through the impeller 54. Impeller blades or vanes 213 extend radially outward from the hub 214. In the illustrated configuration, the impeller 54 includes an upper plate, disc, or shroud 217 and a lower plate, disc, or shroud 215. The upper shroud 217 extends radially outward from the hub 214. In the illustrated configuration, the upper shroud 217 extends at an angle radially outward and upward or downstream from the hub 214. The lower shroud 215 extends radially outward from the skirt 218. In the illustrated configuration, the lower shroud 215 extends at an angle radially outward and upward or downstream from the skirt 218. The impeller blades 213 can extend between (e.g., axially between) the lower 215 and the upper shroud 217. The illustrated impeller 54 can therefore be considered a shrouded impeller. The hub 214, blades 213, lower shroud 215, and upper shroud 217 define fluid flow paths through the impeller 54. An outlet or exit 203 of the impeller 54 can be formed or defined between, e.g., at least partially radially between, upper or downstream ends of the lower shroud 215 and the upper shroud 217. As shown, the impeller 54 also includes a balance ring 212 extending upwardly or downstream, e.g., extending longitudinally upwardly or downstream along an axis parallel to a longitudinal axis of the shaft 58, from a top or downstream surface of the upper shroud 217.

In some diffusers 56, the bearing housing 260 can form or define a bore through which the shaft 58 extends. Other diffusers 56 include a central hub 234 that surrounds the bore through which the shaft 58 extends, as also shown in FIG. 3. As shown in FIG. 4, the diffuser 56 also includes a balance ring step 236 radially spaced from and radially or circumferentially surrounding the bearing housing 260 or central hub 234. A lower plate 238 extends between (radially between) and connects the balance ring step 236 and the bearing housing 260 or central hub 234. An outer housing 230 of the diffuser 56 is radially spaced from and radially or circumferentially surrounds the balance ring step 236. Diffuser blades or vanes extend between the outer housing 230 and the balance ring step 236 and/or lower plate 238. At least portions of the outer housing 230, balance ring step 236, vanes, and/or lower plate 238 define fluid flow paths through the diffuser 56.

A radially outer surface of the balance ring 212 of a given impeller 54 can contact or be disposed adjacent or facing a radially inner surface of the balance ring step 236 of the next sequential downstream diffuser 56. The balance ring 212 partially defines a balance ring cavity 220 formed radially between the balance ring 212 and the shaft 58, the bearing housing 260, or the central hub 234 of the diffuser 56. A tip clearance or balance ring clearance 211 is formed or defined axially between an uppermost or downstream-most edge or tip 223 of the balance ring 212 and a lower or generally upstream facing surface of the diffuser lower plate 238, as shown in FIG. 4.

Figure 5:
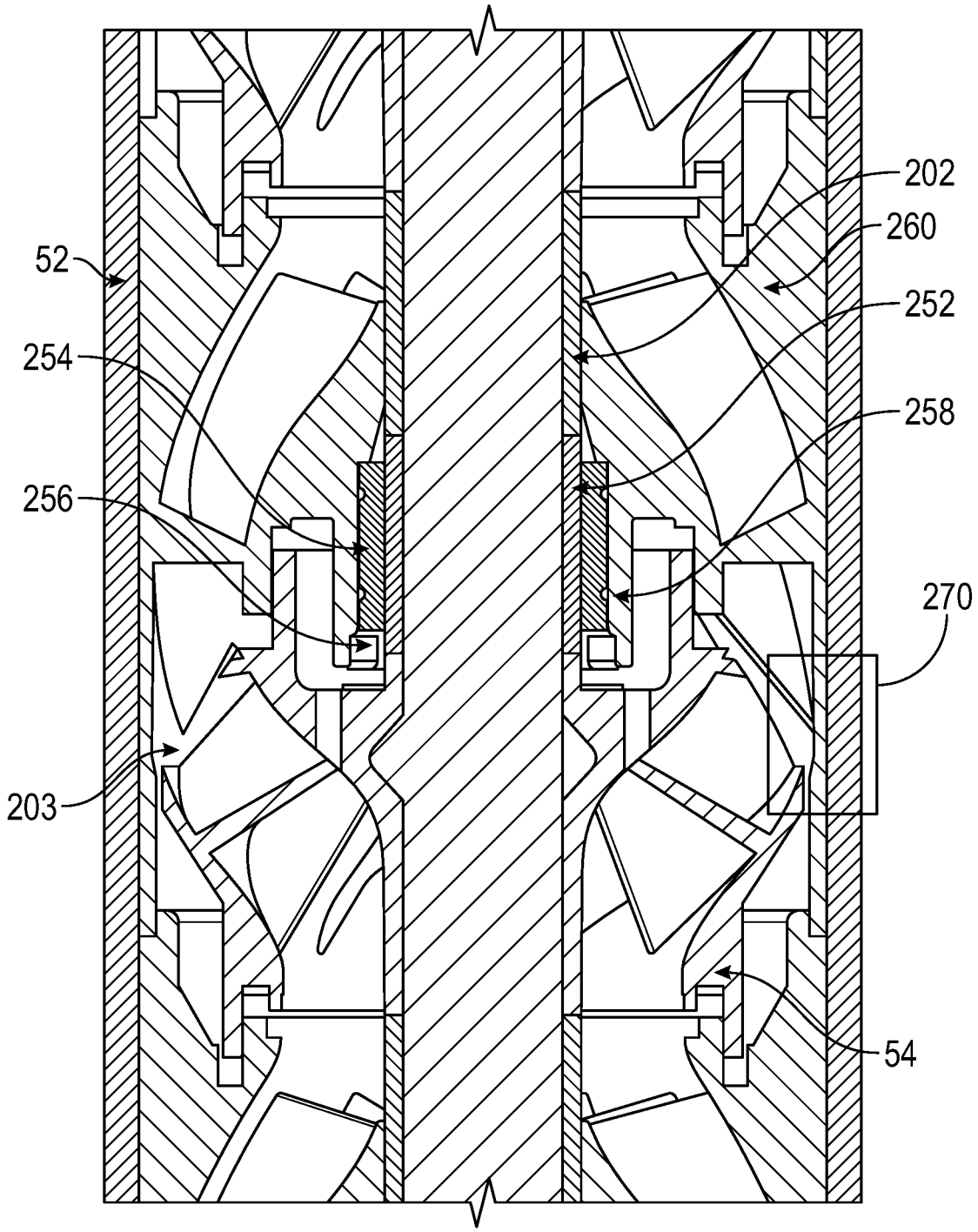
FIG. 5 shows a longitudinal cross-section of a portion of an ESP including a conventional stage design.
Figure 6:
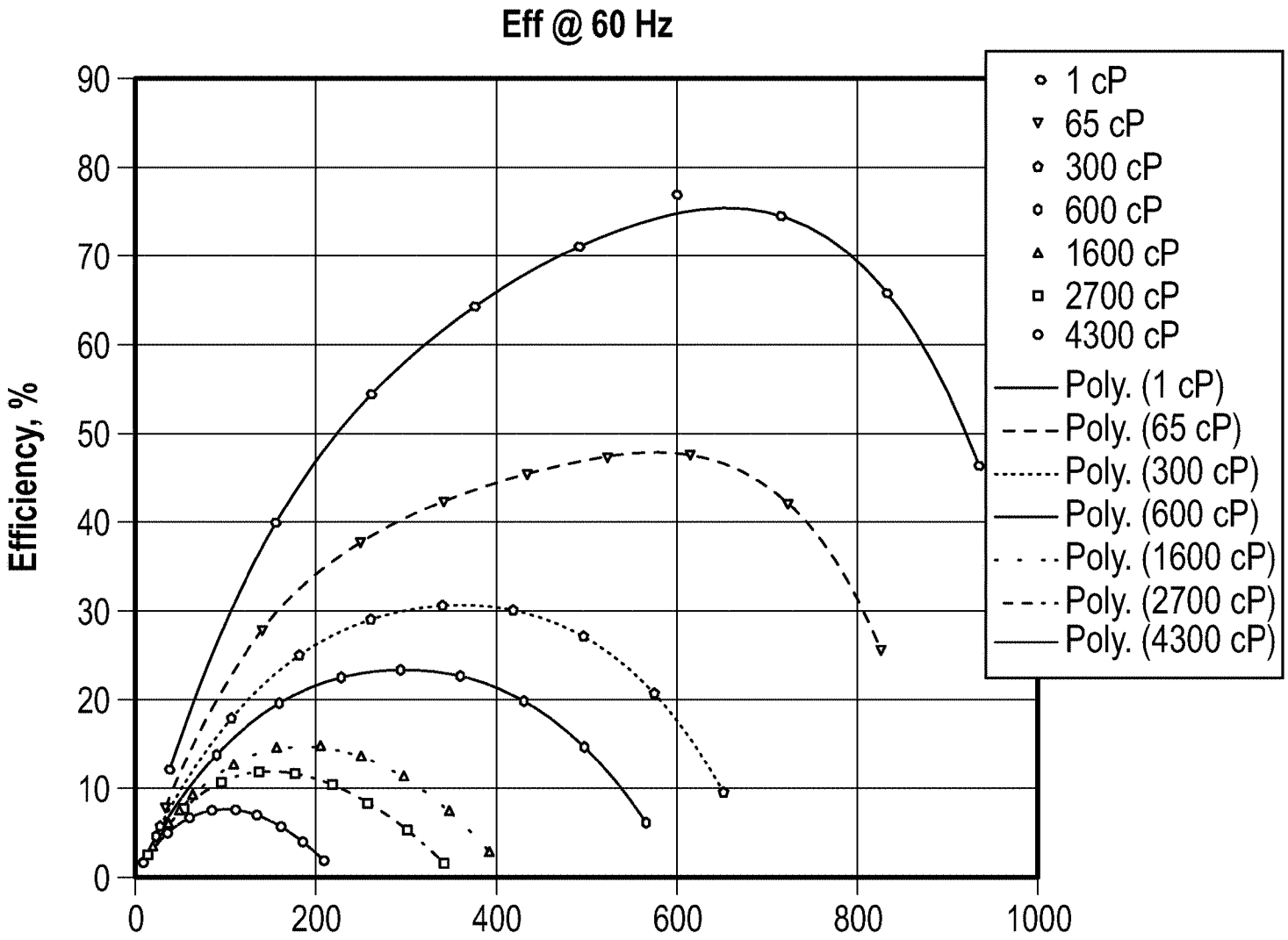
FIG. 6 shows a graph of performance of the ESP of FIG. 5 with fluid of various viscosities.

Conventional mixed flow stage designs for ESPs typically include a "straight" break water area 270, as shown in FIG. 5, to maximize the hydraulic design space. The break water area 270 is an area or section of the diffuser 56 (e.g., of an inner surface of the outer housing 230 of the diffuser 56) where fluid exiting the impeller 54 outlet 203 contacts a surface of the adjacent diffuser 56. In conventional designs, this area 270 is straight, or runs parallel to a longitudinal axis of the pump. However, this design can cause significant hydraulic losses within the impeller flow passage and diffuser. Conventional mixed flow stages, for example as shown in FIG. 5, are designed based on water as the pumping medium. Therefore, hydraulic and viscous losses are different when pumping viscous fluid, and such conventional designs may be inferior when pumping viscous fluid with different viscosities. FIG. 6 illustrates performance of an example conventional pump having a straight break water 270 at different viscosities. As shown, as viscosity increases, efficiency decreases. The reduction of efficiency when pumping viscous fluid is due to viscous losses within the stage and pump.

Figure 7A:
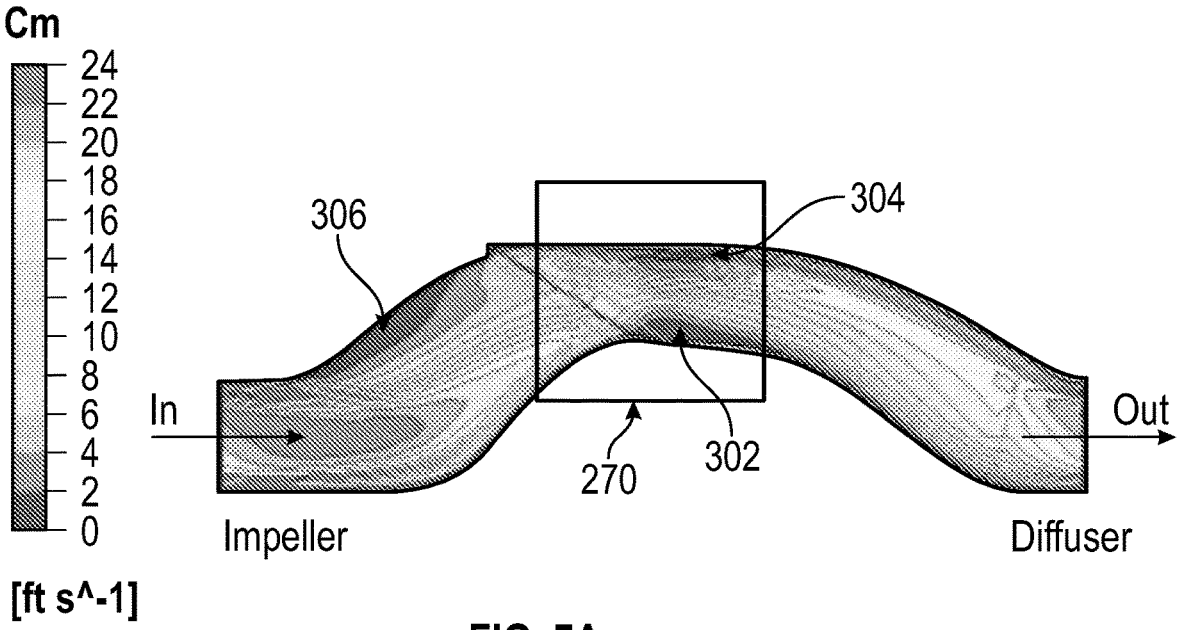
FIG. 7A shows meridional velocity of flow through a stage of the ESP of FIG. 5.
Figure 7B:
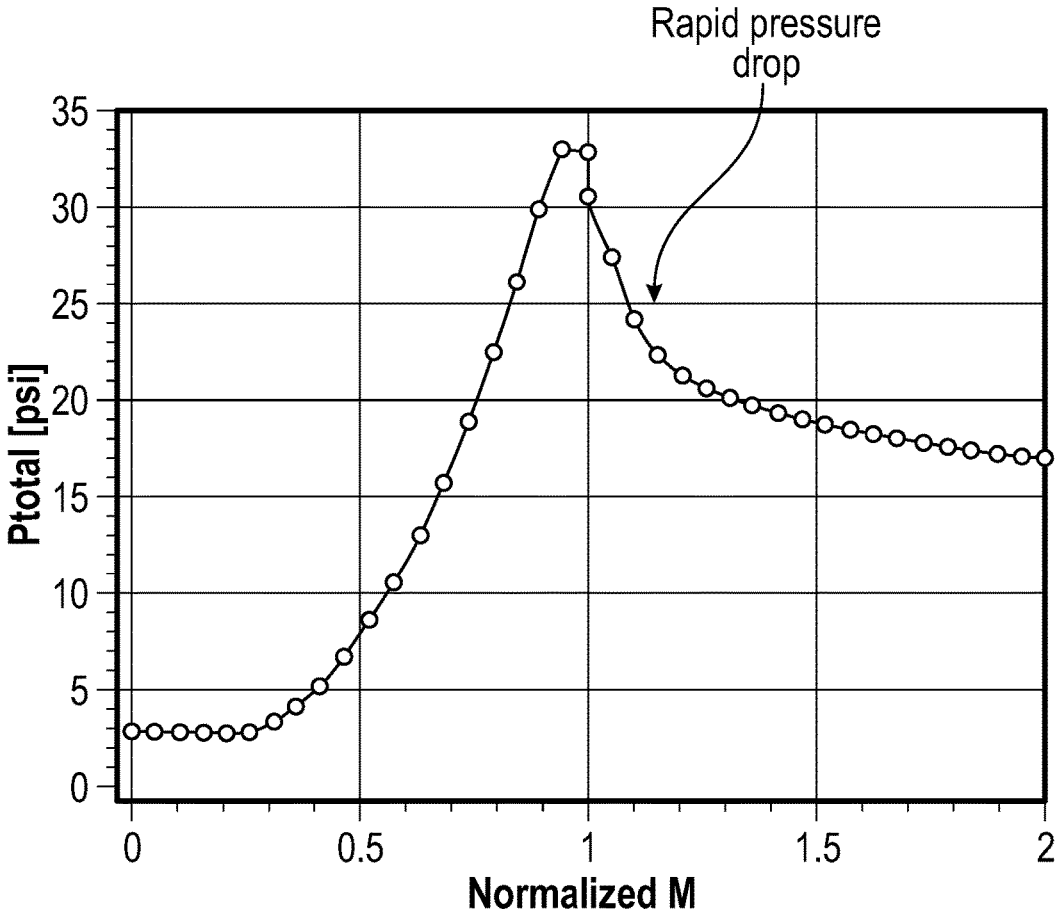
FIG. 7B shows streamwise mass averaged Ptotal vs. averaged normalized M, with 1 at the start of the diffuser, of the ESP of FIG. 5.

FIG. 7A illustrates the meridional velocity of fluid flow through a conventional stage, showing fluid flow into an impeller from the left side of the figure, and out from a diffuser on the right side of the figure. As shown, there is a thick boundary layer on the impeller hub side, and stalling flow near the shroud side, indicated by area 306. The diffuser flow passage has a small stall flow region 302 near the vane leading edge hub side and a larger velocity gradient near the flow passage mid span region, indicated by area 304, causing a large pressure drop near the entry region, as shown in FIG. 7B, where Normalized M=1 indicates the start or inlet of the diffuser 56.

Figure 8A:
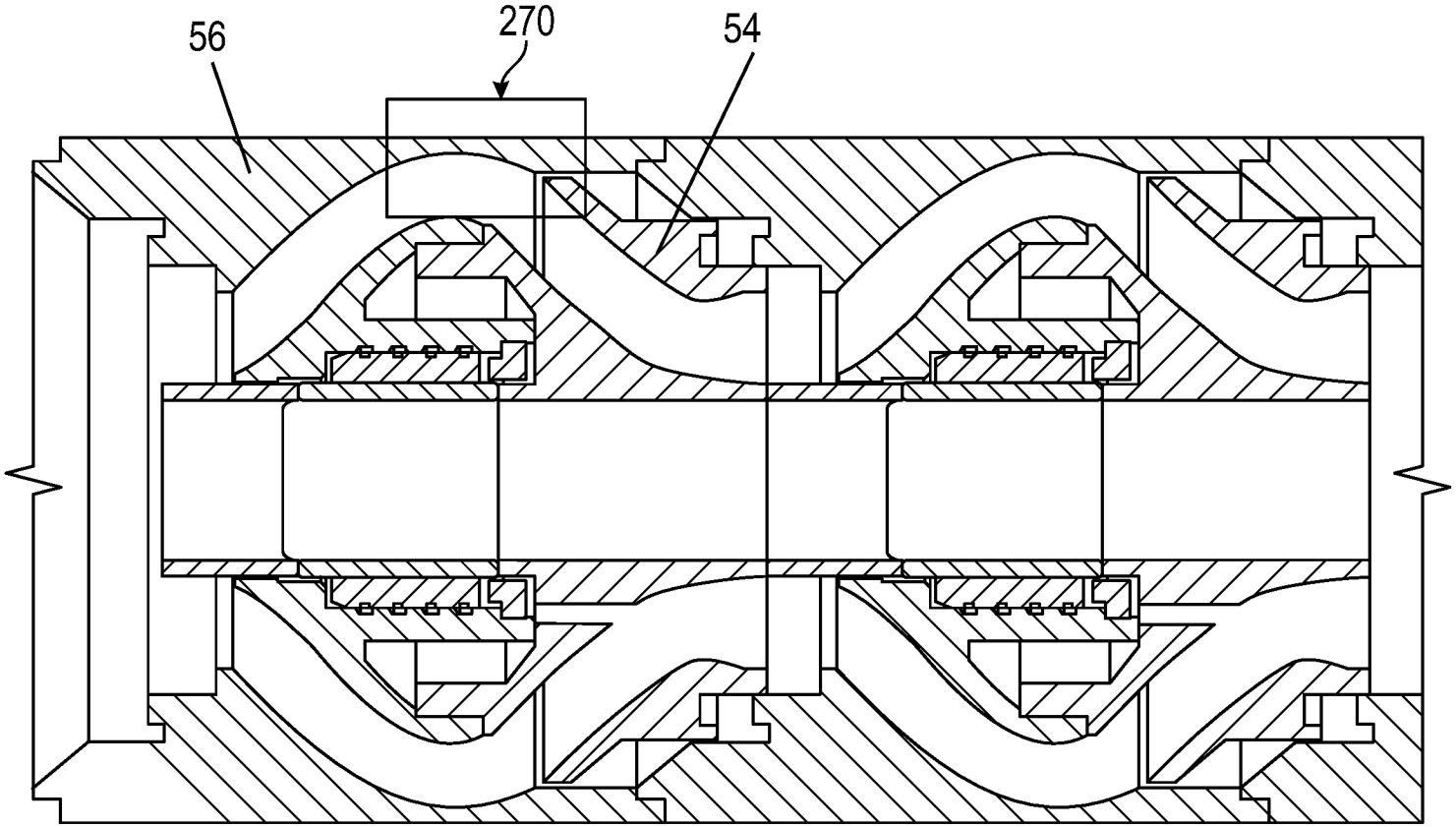
FIG. 8A shows a longitudinal cross-section of a portion of an ESP including a stage according to the present disclosure.

The present disclosure provides a diffuser having a curved break water region 270, for example as shown in FIG. 8A, optimized for viscous fluids. The curvature of the break water region 270 can be considered concave from the perspective inside the flow path. In some configurations, for example as shown in FIG. 8A, the curvature can start from a point of the inner surface of the outer housing 230 adjacent or proximate the upper or downstream tip of the lower shroud 215 and curve or bulge radially outward.

The curved break water region 270 advantageously reduces hydraulic loss and improves pressure recovery of the stage. A stage design optimized for high viscosity applications can include a high impeller blade angle and low blade count, for example 4-6 vanes, to maximize head while reducing viscous frictional loss. The viscous fluid discharges from the impeller and enters the diffuser by following the break water 270 curvature of the diffuser. Such a configuration can reduce or minimize total head loss. In some configurations, a stage according to the present disclosure including a curved break water region 270 also includes a cut back shroud and/or hub impeller to further reduce disk frictional losses due to viscous shear on the shroud and/or hub surfaces.

Figure 8B:
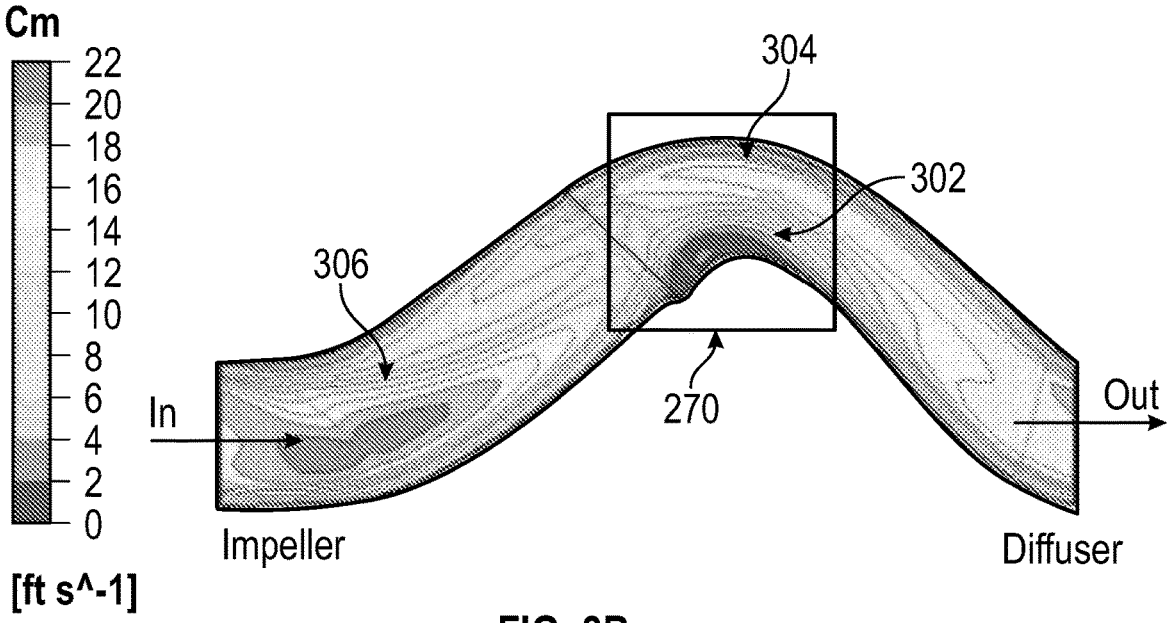
FIG. 8B shows meridional velocity of flow through a stage of the ESP of FIG. 8A.
Figure 8C:
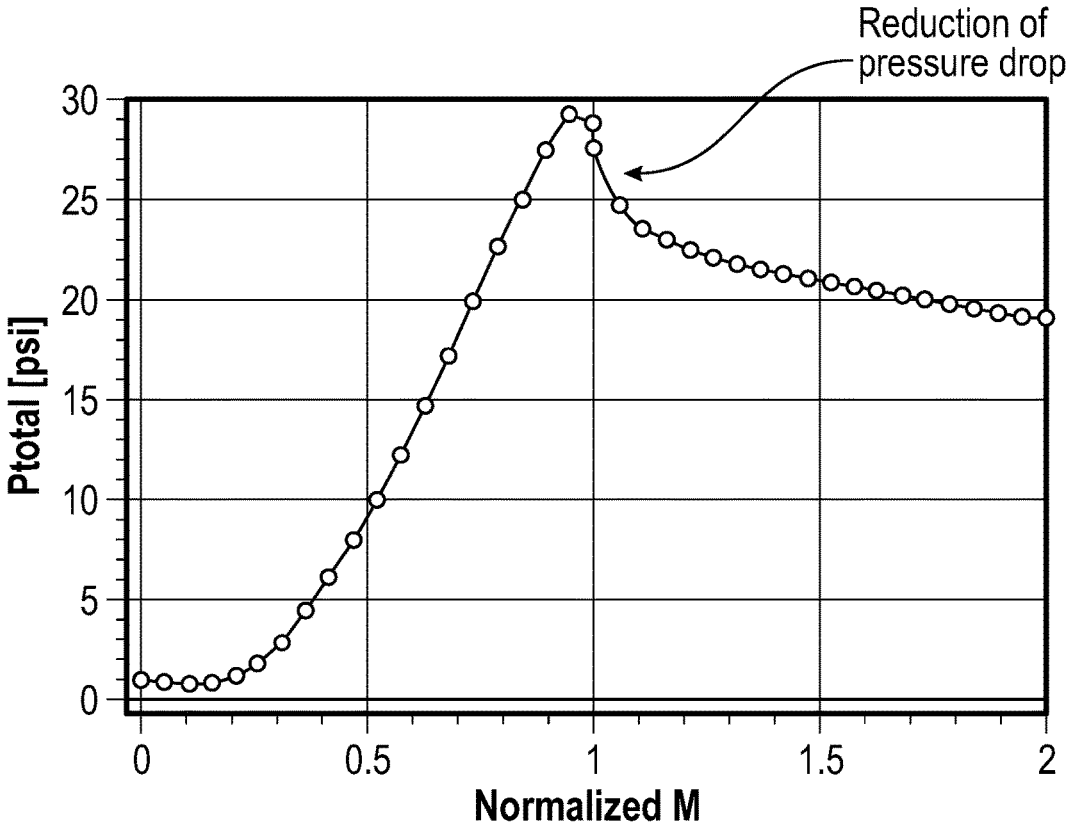
FIG. 8C shows streamwise mass averaged Ptotal vs. averaged normalized M, with 1 at the start of the diffuser, of the ESP of FIG. 8A.

FIG. 8B illustrates the meridional velocity of fluid flow through a stage according to the present disclosure, showing fluid flow into an impeller from the left side of the figure, and out from a diffuser on the right side of the figure. As shown, there is no stalling flow in region 306 near the impeller shroud side. The diffuser flow passage has a small stall flow region 302 observed near the vane leading edge hub side, but the velocity gradient near the flow passage mid-span region, indicated by area 304, is greatly reduced. This reduces or minimizes the pressure drop near the entry region, as shown in FIG. 8C.

Figure 9:
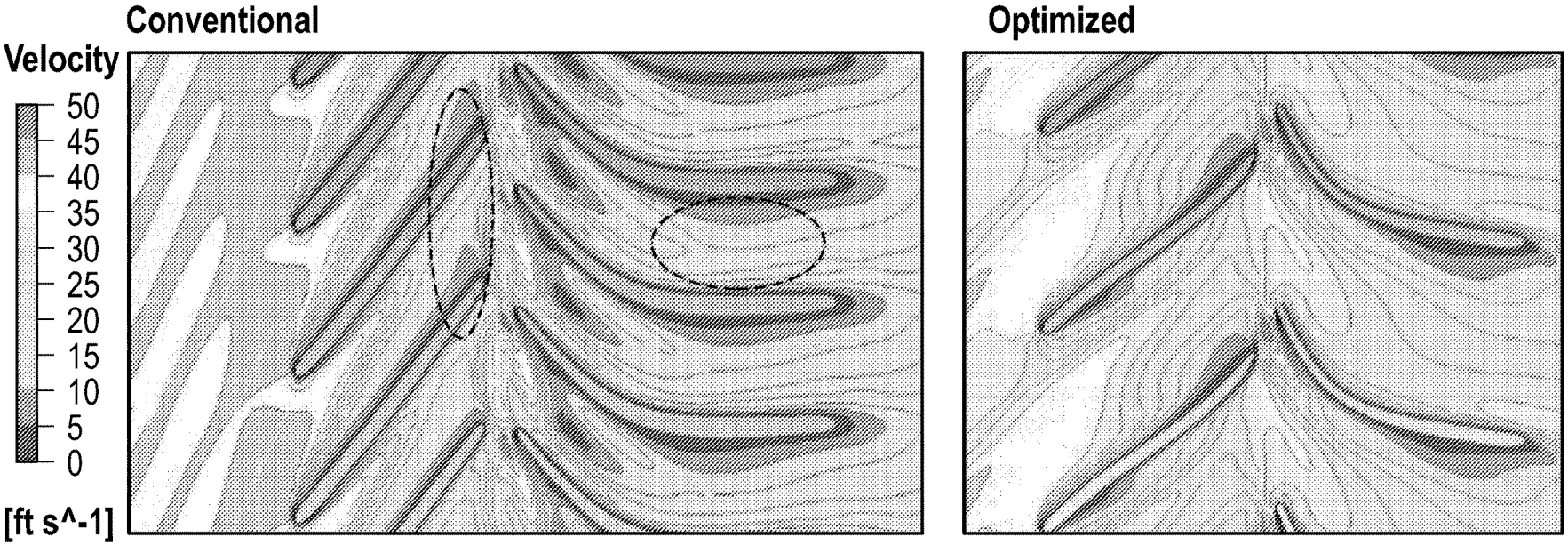
FIG. 9 shows a comparison of the velocity field of a stage having a straight break water on the left, and a stage having a curved break water on the right.
Figure 10:
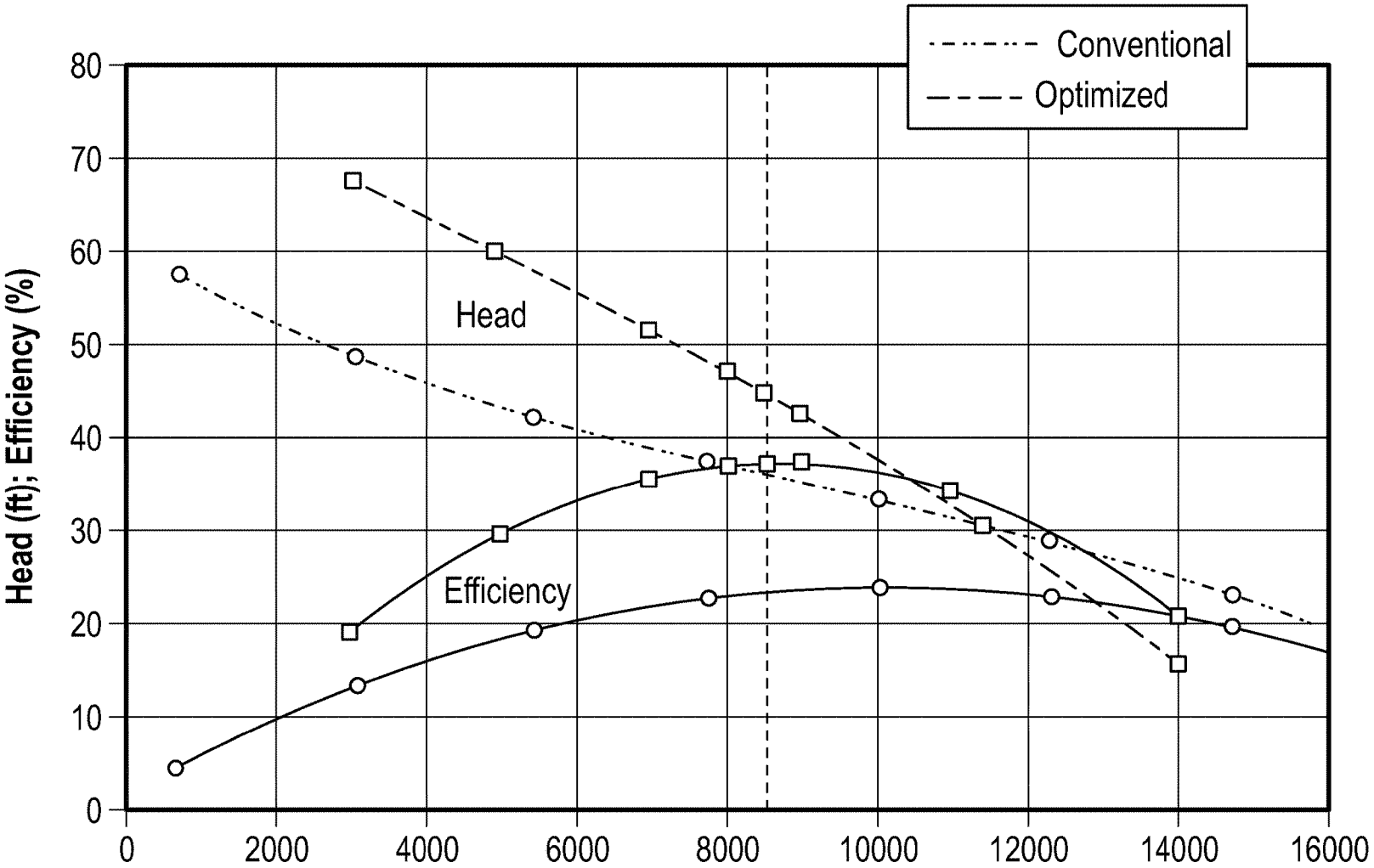
FIG. 10 shows a graph of estimated performance of a stage having a curved break water optimized for viscous fluids compared to the ESP of FIG. 5.

FIG. 9 shows a comparison of the velocity field of a stage having a straight break water on the left, and a stage having a curved break water on the right. This comparison shows reduced regions of stall or low velocity fluid and reduced cross-passage velocity gradients in the stage having a curved break water. FIG. 10 illustrates estimated performance of a stage including a diffuser having a curved break water compared to a conventional straight break water design.

Figure 11:
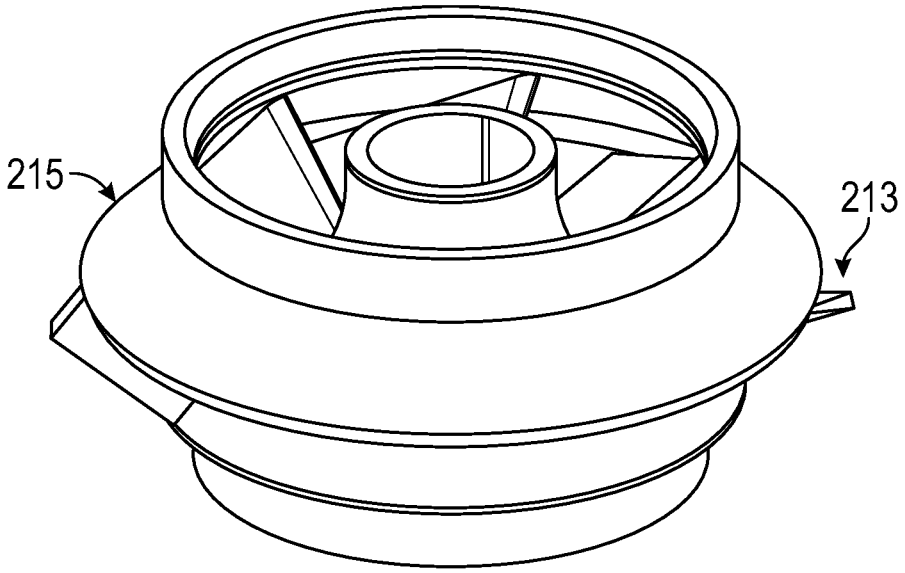
FIG. 11 shows a perspective view of an impeller having a cut back shroud.
Figure 12:
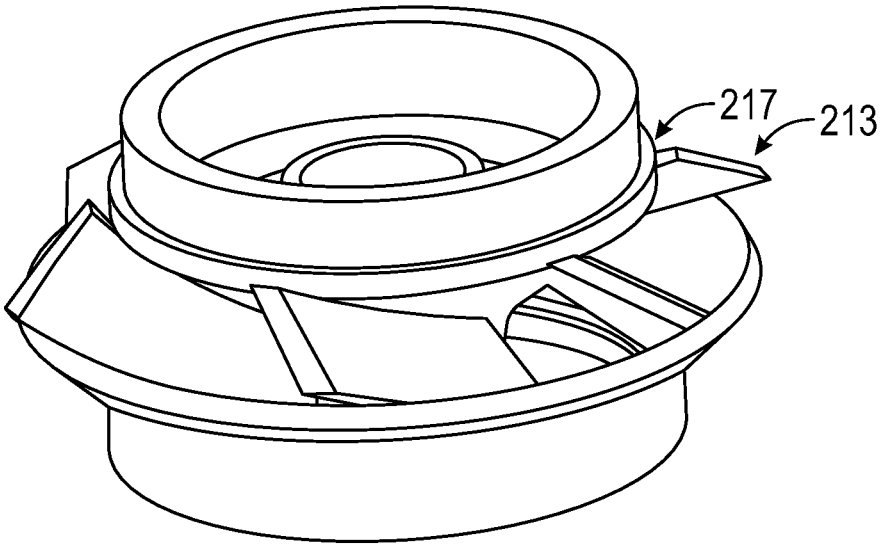
FIG. 12 shows a perspective view of an impeller having a cut back hub.

In some configurations, ESP stages optimized for viscous fluids according to the present disclosure include an impeller having a cut back or reduced shroud (lower shroud 215), as shown in FIG. 11, and/or a cut back hub (upper shroud 217), as shown in FIG. 12. In such configurations, the diameter of the shroud and/or hub is (are) less than the outer diameter of the impeller vanes 213. Such configurations can advantageously reduce disk friction losses due to fluid shear between the rotating faces (hub and shroud) and the slower rotating fluid inside the front seal cavity 222 and balance ring cavity 220. As disk friction losses are proportional to the disk diameter raised to the fifth power, a small reduction in impeller OD can reduce disk friction losses significantly and further improve viscous performance of the pump.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. An electric submersible pump stage comprising:

an impeller configured to rotate about a longitudinal axis, the impeller comprising:

a hub;

an upper shroud extending from the hub;

a lower shroud generally circumferentially surrounding the upper shroud;

a plurality of vanes each extending to a pointed edge at a periphery of the impeller and each positioned at least in part between the lower shroud and the upper shroud, the plurality of vanes having an outer vane diameter that is greater than an outer shroud diameter of the lower shroud, wherein the plurality of vanes includes between 4 and 6 vanes based on a viscosity of a fluid to be pumped; and a fluid exit defined between downstream ends of the upper shroud and the lower shroud; and a stationary diffuser comprising:

a central hub;

a balance ring step radially spaced from and radially or circumferentially surrounding the central hub;

a lower plate extending between and connecting the balance ring step and the central hub;

an outer housing radially spaced from and radially or circumferentially surrounding the balance ring step and the lower plate; and a break water area defined between the balance ring step and the outer housing proximate the fluid exit of the impeller, wherein, based on the viscosity of the fluid to be pumped, the break water area has a continuous concave curvature configured to reduce hydraulic loss, improve pressure recovery of the stationary diffuser downhole of a mid-span region of the stationary diffuser, and reduce slackwater at the upper shroud, the lower shroud, and the mid-span region between the impeller and the stationary diffuser, wherein the break water area has the continuous concave curvature along a length of the break water area in a longitudinal direction and across the outer housing of the stationary diffuser to an outlet of the stationary diffuser, and wherein the break water area does not include a straight section.

2. The electric submersible pump stage of claim 1, wherein the stationary diffuser further comprises a plurality of blades extending between the outer housing and the balance ring step, the lower plate, or both the balance ring step and the lower plate, wherein the break water area has the continuous concave curvature from proximate the fluid exit of the impeller to the plurality of blades.

3. The electric submersible pump stage of claim 2, wherein a radially inner surface of the outer housing defines an outer radial edge of the break water area, and wherein the radially inner surface has an inner concave curvature along the length of the break water area so as to not include an inner straight section.

4. The electric submersible pump stage of claim 1, wherein an upper shroud diameter of the upper shroud is less than the outer vane diameter of the plurality of vanes of the impeller.

5. The electric submersible pump stage of claim 1, wherein the impeller comprises a cutback lower shroud.

6. The electric submersible pump stage of claim 1, wherein the break water area extends longitudinally between a first end and a second end, and wherein the break water area has a maximum diameter at a location between the first end and the second end.

7. The electric submersible pump stage of claim 1, wherein a distance between the upper shroud and the lower shroud at the fluid exit is substantially the same as a radial distance between the balance ring step and the outer housing at a radially outermost position of the break water area.

8. An electric submersible pump stage comprising:

an impeller configured to rotate about a longitudinal axis, the impeller comprising:

a hub;

an upper shroud extending from the hub;

a lower shroud generally circumferentially surrounding the upper shroud;

a plurality of vanes each extending to a pointed edge at a periphery of the impeller and each positioned at least in part between the lower shroud and the upper shroud, the plurality of vanes having an outer vane diameter that is greater than an outer shroud diameter of the lower shroud, wherein the plurality of vanes includes between 4 and 6 vanes based on a viscosity of a fluid to be pumped; and a fluid exit defined between downstream ends of the upper shroud and the lower shroud; and a stationary diffuser comprising, based on the viscosity of the fluid to be pumped, a continuous curved break water area proximate the fluid exit of the impeller configured to reduce hydraulic loss, improve pressure recovery of the electric submersible pump stage downhole of a mid-span region of the stationary diffuser, and reduce slackwater at the upper shroud, the lower shroud, and the mid-span region between the impeller and the stationary diffuser, wherein the continuous curved break water area has a continuous concave curvature along a length of the continuous curved break water area in a longitudinal direction to an outlet of the stationary diffuser.

9. The electric submersible pump stage of claim 8, wherein the continuous curved break water area does not include a straight section.

10. The electric submersible pump stage of claim 9, the stationary diffuser comprising:

a central hub;

a balance ring step radially spaced from and radially or circumferentially surrounding the central hub;

a lower plate extending between and connecting the balance ring step and the central hub;

an outer housing radially spaced from and radially or circumferentially surrounding the balance ring step; and a plurality of blades positioned between the outer housing and the balance ring step, the lower plate, or both the balance ring step and the lower plate, wherein the continuous concave curvature extends longitudinally between proximate the fluid exit of the impeller and proximate the plurality of blades.

11. The electric submersible pump stage of claim 10, wherein a radially inner surface of the outer housing defines an outer radial edge of the continuous curved break water area, and wherein the radially inner surface has an inner concave curvature longitudinally between proximate the fluid exit of the impeller and proximate the plurality of blades so as not to include an inner straight section.

12. An electric submersible pump stage comprising:

an impeller configured to rotate about a longitudinal axis, the impeller comprising:

an upper shroud extending from a hub;

a lower shroud generally circumferentially surrounding the upper shroud, an outlet of the impeller defined between downstream ends of the upper shroud and the lower shroud; and a plurality of vanes each extending to a pointed edge at a periphery of the impeller and each positioned at least in part between the lower shroud and the upper shroud, the plurality of vanes having a vane outer diameter that is greater than an outer shroud diameter of the lower shroud, wherein the plurality of vanes includes between 4 and 6 vanes based on a viscosity of a fluid to be pumped; and an associated stationary diffuser configured to receive fluid exiting the outlet of the impeller, the associated stationary diffuser comprising:

a central hub configured to surround a shaft;

a balance ring step radially spaced from and circumferentially surrounding the central hub;

a lower plate extending between and connecting the balance ring step and the central hub;

an outer housing radially spaced from and circumferentially surrounding the balance ring step;

a plurality of blades extending between the outer housing the balance ring step and the lower plate; and at least portions of the outer housing, the balance ring step, the plurality of blades, and the lower plate defining a fluid flow path through the associated stationary diffuser, wherein a radially inner surface of the outer housing includes a region configured to be contacted by fluid exiting the outlet of the impeller, wherein, based on the viscosity of the fluid to be pumped, the region has a continuous curvature configured to reduce hydraulic loss, improve pressure recovery in the electric submersible pump stage downhole of a mid-span region of the stationary diffuser, and reduce slackwater at the upper shroud, the lower shroud, and the mid-span region between the impeller and the stationary diffuser, wherein the region has the continuous curvature along a length of the region in a longitudinal direction and across the outer housing to a diffuser outlet of the associated stationary diffuser, wherein the region does not include a straight section.

13. The electric submersible pump stage of claim 12, wherein the continuous curvature is a continuous concave curvature from a perspective inside the fluid flow path through the associated stationary diffuser.

14. The electric submersible pump stage of claim 12, wherein the region curves or bulges radially outward.

15. The electric submersible pump stage of claim 12, wherein the region is located adjacent or proximate the outlet of the impeller.

16. The stage of claim 12, wherein the upper shroud, the lower shroud, or both the upper shroud and the lower shroud is reduced or cut back.

* * * * *